US005318304A

United States Patent [19]

Reppas

[11] Patent Number: 5,318,304

[45] Date of Patent: Jun. 7, 1994

[54] SPORTS BOARD GAME

[76] Inventor: Robert G. Reppas, 48 Highland Ave. #2, Cambridge, Mass. 02319

[21] Appl. No.: 52,638

[22] Filed: Apr. 23, 1993

[51] Int. Cl.[5] ..... A63F 3/00

[52] U.S. Cl. ..... 273/244; 273/256; 273/93 C

[58] Field of Search ..... 273/256, 247, 244, 259, 273/93 C, 94

[56] References Cited

U.S. PATENT DOCUMENTS

| | | | |
|---|---|---|---|
| 4,010,957 | 3/1977 | Tricoli | 273/256 |
| 4,027,882 | 6/1977 | Rosenberg | 273/256 |
| 4,279,422 | 7/1981 | Shaw | 273/256 |
| 4,486,022 | 12/1984 | Dixon | 273/256 |
| 4,585,233 | 4/1986 | Wilson | 273/256 |
| 4,832,346 | 5/1989 | Pierce | 273/247 |
| 5,135,230 | 8/1992 | Denman et al. | 273/244 |

FOREIGN PATENT DOCUMENTS

| | | | |
|---|---|---|---|
| 1479092 | 7/1977 | United Kingdom | 273/247 |
| 2051590 | 7/1980 | United Kingdom | 273/247 |

*Primary Examiner*—Benjamin H. Layno
*Attorney, Agent, or Firm*—Harness, Dickey & Pierce

[57] ABSTRACT

A board game wherein each player represents the owner of a sports team and the object of the game is to build a profitable and winning team. Each player advances a playing piece along an endless path of contiguous spaces and is free to engage in deal-making involving trades and sales with the other owners. The game may be directed toward any suitable team sport since the game is more closely related to the business aspects of sports and requires only a minimal knowledge of the rules of the sport itself.

18 Claims, 2 Drawing Sheets

SPORTS BOARD GAME

BACKGROUND AND SUMMARY OF THE INVENTION

The present invention relates generally to board games and, more particularly, to a novel board game in which each player assumes the role of an owner of a sports team.

Board games in which players generally advance along an endless path of contiguous spaces about the periphery of a game board, although varied with respect to their objects and manner of play, are well known. Also known are various types of board games which involve a particular sport or sports team. It is therefore an object of the present invention to provide a novel sports related board game in which each player acts as the owner of a sports team and wherein the game is directed toward the business oriented aspects of owning a sports team rather than to a sport itself. Although there presently exist computer network based sports games in which sports enthusiasts act as team managers, this type of game is typically played over the course of a season and the outcome is based on a statistical algorithm utilizing performance statistics of actual players of professional sports. The present game, in contrast, is designed to be self-contained, more socially interactive and not dependent upon actual statistics.

In accordance with the present invention, a playing board is provided having an endless path of contiguous spaces, each indicative of a particular situation or instruction. In turn, each player advances a playing piece along the path from space to space, obeying the instructions corresponding to the space on which (s)he lands. In addition to advancing along the endless path, players are encouraged to initiate deals with one another involving the trade or sale of a team player or other asset. The objective of the game is to bargain with and outwit the other player/owners and to capitalize on the breaks of the game in order to obtain a profitable and winning team.

The rules of the game of this invention are such that it can be easily learned but so that it allows for continued innovation by the players. The game provides competition between players based not only on chance and the breaks of the game but also upon strategic business and negotiating skills. The game is educational in that the players may test and sharpen their communication and negotiation skills and the interpersonal skills learned in playing the game may be applied to real world situations.

Additional objects, advantages and features of the present invention will become apparent from the following description and appended claims, taken in conjunction with the accompanying drawings.

DETAILED DESCRIPTION OF THE PREFERRED EMBODIMENT

Although the game described herein is in this preferred embodiment a game of baseball team owners, it should become readily apparent upon reading this detailed description that the game is equally well suited for application to numerous other sports. Such sports envisioned by the inventor include football, basketball, soccer, hockey and virtually any other team sport. Since the sports to which this game may relate each has a team made up of individual team players, a player of the present game will hereinafter be designated as an "owner" in order to avoid confusion with members of the team.

Figure 1:
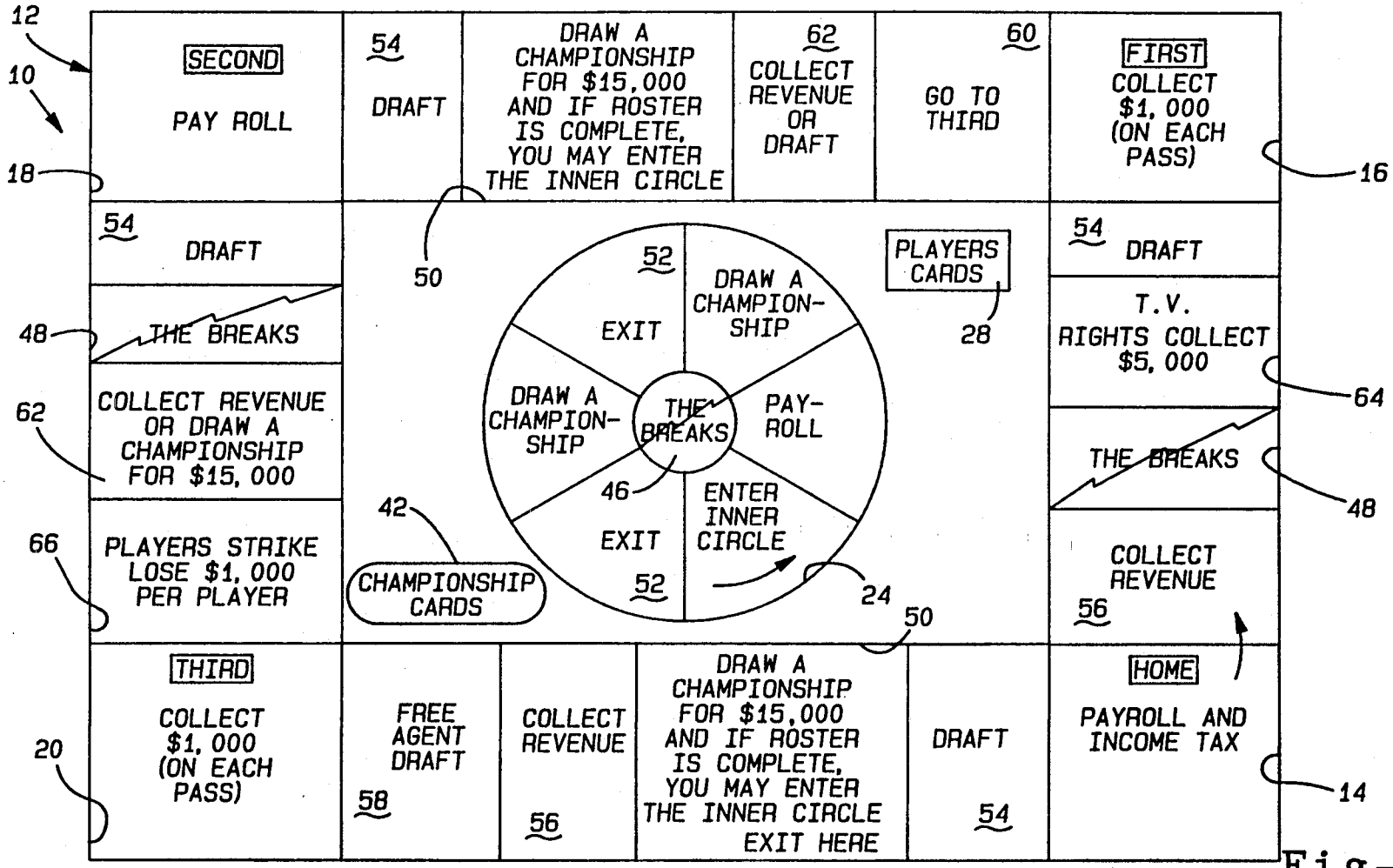
FIG. 1 is a plan view of one preferred game board embodying the sports game of the present invention.

Referring now to FIG. 1, the board game of the present invention includes a playing board denoted generally at 10. The board 10 has printed or otherwise disposed thereon an endless and preferably peripheral path 12, divided into a plurality of contiguous playing spaces disposed in a side-by-side relation. Each space contains a designation indicating a task, reward or penalty for an owner landing on that space. Each owner selects a playing piece (not shown) to be moved from space to space along path 12 in response to a number determined by a random number generating means such as a die or spinner. Each playing piece is unique from the others and is preferably representative in some fashion of a sport or sports team (e.g., a team mascot or symbol).

Endless path 12 is preferably configured so as to be conceptually or visually representative of the playing field used in the particular sport to which the game relates. As the game of this illustrative embodiment relates to baseball, the path 12 shown in FIG. 1 is configured to represent the base path of a baseball diamond, having a starting space 14 corresponding to home plate and spaces 16, 18, and 20 which correspond to first, second and third bases, respectively. Board 10 may also have a second path 24 of contiguous spaces, preferably disposed interior to path 12.

Figure 2:
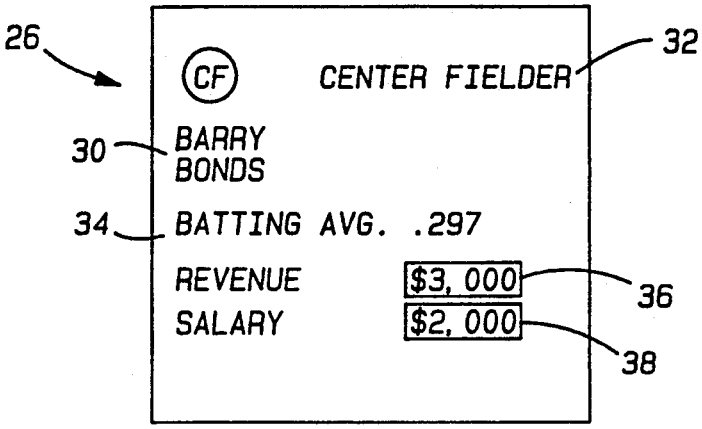
FIG. 2 shows a sample player card that is part of a stack of player cards.

A plurality of stacks of cards are provided, these cards being drawn by owners from time to time in accordance with various spaces on paths 12 or 24 on which an owner's playing piece lands. The back sides of the cards of each of these stacks are preferably differentiable from one another such as by shape, color or indicia placed thereon. A stack of player cards 26 may be set face down on a designated space 28 of game board 10 or may alternately be placed on a surface outside the board 10. As shown in detail in FIG. 2, each player card 26 preferably contains indicia of the name of a player 30, the position played 32 and a number indicative of a performance related statistic such as a batting average 34.

Each player card 26 also contains a number, preferably a dollar value 36, representative of the revenue to be collected by the owner based upon the quality and popularity of the player. A salary indication 38 contains a monetary value corresponding to the salary commanded by the player. For reasons which will become apparent later, the most valuable players are those having a higher revenue value 36 and a lower salary indication 38. The information on player cards 26 may be based wholly upon fictitious players and statistics but, if appropriate licensing is obtained, may alternately be based upon actual existing professional players. The same is true regarding the playing pieces which may be made representative of actual existing leagues and teams.

Figure 3:
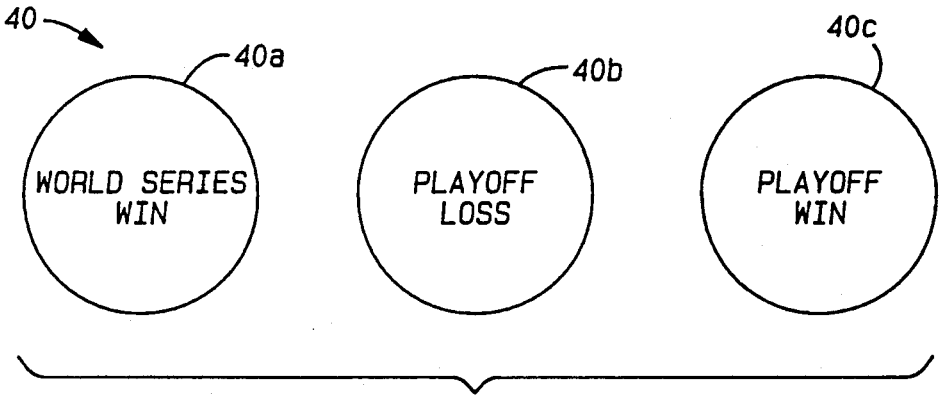
FIG. 3 illustrates designations on respective cards forming a stack of championship cards.

A stack of championship cards 40 is placed face down either on a designated space 42 on board 10 or on a suitable surface off of board 12. Each championship card 40 is preferably one of three kinds, as shown in FIG. 3, but alternately additional types of cards could also be provided. Championship card 40*a* represents a league championship win, in this exemplary embodiment a winning of the World Series. Championship card 40*b* contains indicia representative of a playoff game loss and card 40*c* indicia of a playoff game win. Depending upon the sport to which the present game relates, these championship cards could alternately represent championships such as Stanley Cup or Super Bowl wins and could include wins, losses or ties of semi-final as well as final playoff rounds.

Figure 4:
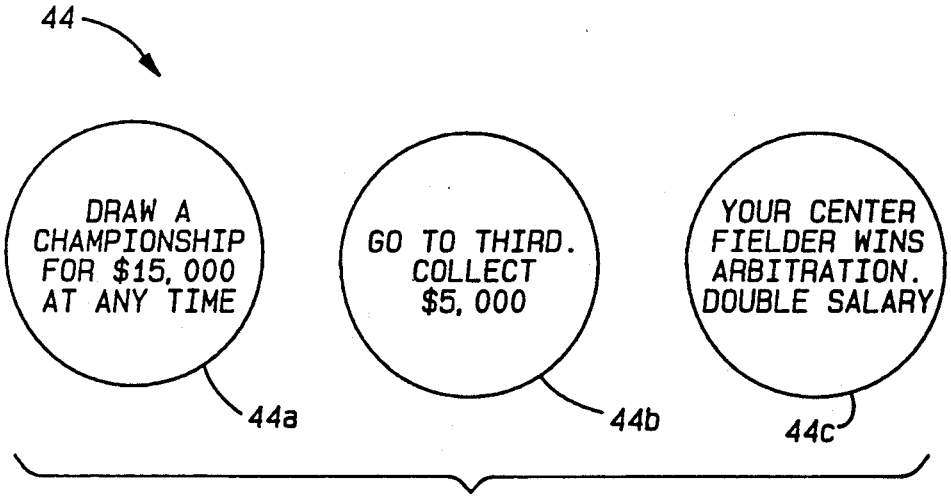
FIG. 4 shows designations on sample cards forming a stack of breaks cards.

A stack of breaks cards 44 containing indicia of chance or a break in the game is also provided and may be placed face down on a designated space such as space 46 in the center of path 24, or may be otherwise placed off of board 12. FIG. 4 shows sample breaks cards 44 in which card 44*a* allows a player to draw a championship card 40 upon payment of $15,000. Breaks cards such as card 44*b* instruct an owner to move his or her playing piece to a predetermined space on path 12. Cards such as card 44*c* have a more permanent effect on items such as the salary to be paid to a player for the remainder of the game. One skilled in the art will recognize that any number of a wide variety of occurrences or situations representative of chance, luck or "breaks" in the game could be readily incorporated into indicia on breaks cards 44 such as:

Free Agent Draft NOW.
Proceed to nearest Collect Revenue.
Circle the bases to Go Home.
When roster is complete, enter the Inner Circle at any time.
If roster is complete, enter the Inner Circle now, or lose opportunity.
Keep this card to stop collective action by other owners against you.
Settle one Player's Strike.
Draw a Championship card for Free at any time.
Draw a Championship card for $15,000 at any time.
Commissioner fines you $2,000 for tampering.
Owner attacks local sportswriter. Pay $1,000 fine, but receive satisfaction.
Collect $1,000 from each owner.
Roseanne Barr sings National Anthem. Apologize to other owners.
Stadium concessions pay off. Collect $5,000.
Fans irate over bad trade. Lose $5,000 in ticket revenue.
Circle the bases and stop on any spot.
Draft NOW.
Pitcher throws no-hitter. Collect $1,000.
Your team's First Baseman injured and lost for the season. Discard with no replacement.
Player punches manager. Roll again.
Astroturf requires mowing. Pay $1,000.
Keep this card to VOID one payroll.
Hotdog vendor spills mustard on fan. Pay $1,000 cleaning bill.
Fan Appreciation Day. Pay (lose) $5,000.
Go to Third, Collect $5,000.
Player breaks ankle. Pay $2,000 in medical expenses.
Your manager, "Loose-Screw" McCoy punches player. Lose next turn.
Pay smiling owners $1,000 each.
Your Center Fielder wins arbitration. Double salary.
Your player with the highest batting average retires.
Your player with the lowest battery average finally starts hitting well! Increase revenue $2,000.

Alternatively, however, these types of chance-based indicia are equally as well suited to being indicia on spaces of path 12 on board 10.

In order to set up the game, the board 10 is placed in a location accessible to each owner. Each owner chooses a game piece and begins by placing his or her piece at the starting space, in this case home plate 14. The breaks cards 44 are shuffled and placed face down in a pile, preferably on a designated space 46 on game board 10. The championship cards 40 and player cards 26 are also shuffled and placed face down on spaces 42 and 28 respectively. One of the owners is preferably designated as "the bank" and is deemed responsible for collecting and dispersing the bank's money. All money paid by an owner other than that being paid to another owner is paid to the bank. Money, preferably in the form of pieces of paper, may be provided in various denominations. For convenience, all monetary transactions may be required to be in increments of a specified amount, such as $1,000 and each owner may also be provided with a pad of paper for keeping track of items such as his or her team roster, team payroll and collectable team revenue.

To begin play, each owner preferably drafts (i.e., draws) three player cards 26 from the stack. Those players drawn by each owner are the first three members of his or her team. However, in order to win, each owner needs to complete his or her roster with at least one player for each position. For instance, in this embodiment in which the game relates to baseball, each owner must obtain at least one pitcher, catcher, first baseman, second baseman, third baseman, shortstop and the three outfielders. Utility type players, in which a player may be able to play more than one position (in this embodiment such as a first baseman who also plays right field) may be provided but each may play only one position at a time and therefore may not count as two players in a roster.

Each owner begins with an equal sum of money, the amount being based proportionally upon the amounts chosen for player salaries, etc. In this preferred embodiment, the starting amount is set at $8,000. Each player takes a turn at rolling the die and the high roller begins the game and moves his or her playing piece from space to space along path 12. Since the path 12 in this embodiment is configured to be representative of a baseball base path, movement therearound is in a counterclockwise direction. However, in an embodiment related to a different sport, this movement could be in a clockwise or other direction, depending upon the exact configuration of path 12.

As with a conventional game of this general type, an owner's playing piece is preferably moved a number of spaces equal to a number randomly generated. The game proceeds as each owner takes turns rolling the die and moving along the base path 12. In order to win the game an owner must collect a sufficient number of player cards 26 necessary to complete his or her team roster and must also win a given number of championships by collecting championship cards 40. An owner in this illustrative embodiment must collect three World Series wins or the equivalent in playoff wins, wherein a playoff win is worth a predetermined fraction (such as one-half) of a World Series win.

Each space on path 12 contains indicia of a penalty, reward or task for an owner whose playing piece lands on that space. Penalizing indica could include causing the owner to lose a turn or pay money. Rewards may be in the form of collecting revenue and a typical task may include moving to a specific space on board 10 or drawing a card. Spaces on path 12 may also contain indicia requiring an owner to choose between two or more options.

At least one space on path 12 is associated with each of the aforementioned stacks of cards. For instance, a breaks card 44 is drawn by an owner landing on one of a plurality of breaks spaces 48 on the base path 12. The owner generally must do what is written on the drawn card 44. However, some of the breaks cards such as card 44*a* preferably contain indicia which allows the card to be held for use later in the game and wherein the card 44 becomes a tradeable asset. Likewise, at least one space 50 along path 12 permits an owner to draw a championship card 40 from the stack, in this preferred embodiment in exchange for payment of $15,000.

Similarly, upon landing on a draft space 54, an owner draws one player card 26 from the stack. Drafting additional players is one way to build a team and complete the team roster. Each player on a team generates revenue for the owner, in an amount indicated by indicia 36. After landing on a space on path 12 such as a collect revenue space 56, the owner receives the total team revenue from the bank. Total team revenue is calculated by adding the revenue values 36 for each player on the team. As the team roster grows, owners may wish to keep track of total team revenue on a separate piece of paper.

Successfully bidding for a free agent may be another way for an owner to add to his or her roster. When any one of the owners lands on a free agent draft space 58 or draws a free agent draft breaks card 40, the top card from the stack of player cards 26 is turned over and all owners enter a bidding war. The highest bidder pays the bank the amount bid and adds that player to his or her team roster.

Numerous other indicia designations may be provided on the spaces of path 12, each designating a rewarding or penalizing outcome for an owner whose playing piece lands on that space. Indicia on spaces such as space 60 require an owner to move his or her playing piece to another space. In the present embodiment space 60 instructs a player to go to third base 20 wherein a predetermined amount of money is collected. Alternately, however, spaces of the type of space 60 could also send a playing piece to any other space such as second base 18 where payroll is due.

When an owner lands on a predetermined space such as home plate 14, very wealthy owners may be required to pay a tax. In this illustrative embodiment, after an owner landing on this space pays his or her payroll, a predefined tax is levied on all money over a predetermined limit, such as 50% of all of the owner's money over $50,000. All income tax is paid to the bank.

Indicia designations such as that on space 62 give an owner whose playing piece lands thereon a choice between two actions, for instance between collecting revenue or drawing from one of the aforementioned stacks of cards. Preferably the choice is between a known positive result and one of chance. For instance, when an owner lands on space 50 and the owner's team roster is complete, his or her playing piece may be allowed to enter an alternative path of contiguous spaces, in this preferred embodiment, inner circle 24.

Once within inner circle 24, an owner during each successive turn moves from space to space around inner circle 24 and may not leave until landing on a designated exit space 52. Path 24 is also preferably an endless path of contiguous spaces and provides at least one space of good fortune as well as at least one space of bad fortune. Indications on each of the spaces of path 24 are preferably such that entrance of the inner circle 24 by an owner is undertaken at great risk but potential reward.

It should be readily apparent that any number of indications may be placed on the spaces of paths 12 and 24. Preferably a wide variety of different designations are used to keep the game interesting. Also, each designation preferably relates to business aspects of sports and includes such items as TV rights (space 64) and player strikes (space 66).

Aside from moving a playing piece from space to space around path 12, each owner is encouraged to engage in deals with the other owners. These deals may include trading or selling players and are designed to add interest to the game in the form of personal interaction between the owners. The rules of the game may be fashioned to promote fairness while providing for a great deal of innovation by the owners. For instance in the present game, player cards 26 are considered assets so owners may trade and sell players to other owners to complete their rosters and build a profitable team. Money and some of the breaks cards 44 are also considered tradeable assets and may be traded. However, championship cards 40 are not considered assets and must be earned and may not be traded, bought or sold. The rules of the present game preferably require each owner to keep all of his or her cards face up. Monetary wealth, however, may be kept secret.

Along with completing a team roster, an owner in this embodiment is concerned with obtaining a profit since championship cards necessary for a win must be purchased. High revenue players are desired, especially those commanding a low salary. When poor quality players are no longer required, they can be discarded. For instance in this particular embodiment, during his or her turn an owner may announce that a particular player is "being placed on waivers". Once on waivers, the player must be offered to the highest bidder, or if there are no bidders, the player is discarded to the bottom of the stack of player cards.

When any owner is unable to pay a debt to another owner or to the bank, (s)he becomes bankrupt if (s)he cannot deal with other owners to raise the money. A bankrupt player is out of the game and his or her cards are taken out of play. The game ends when all but one owner is bankrupt or when one owner meets a predefined standard such as completion of his or her team roster and collection of the equivalent of three championship wins in the form of cards 40.

Preferably, appropriate rules are also provided to ensure fair play. For instance, a prohibition against "tampering" may be provided in the rules wherein an owner who makes an intentional or unintentional error (e.g. plays out of turn, moves a playing piece improperly, or touches another owner's cards or money, etc.) must pay a fine. A rule requiring all other owners to unanimously agree to levy the fine may also be employed. Similarly, an owner may, after rolling the die, be required to move his or her playing piece and accept the consequences presented by the indicia of the space on which the piece lands.

The game preferably becomes progressively more sophisticated as owners become familiar with the basic rules and begin to try more creative deal making techniques. An example of such a technique is collective action wherein the sport holds an antitrust exclusion so that owners may act together to outbid another owner. This is a logical strategy to slow or stop one owner from winning the game. Owners may also make "mega-deals" which involve multiple players, several owners, money, future consideration, rights to future drafts, etc.

If not specifically precluded by the rules, a deal is preferably considered legal as long as all owners are subject to the same rules, conditions and opportunities during the game. By unanimous vote before or during the game, owners may suspend rules or adopt new rules. In this way, the game evolves each time it is played thereby breeding new strategies, complexity and enjoyment as well as encouraging tournament play.

Based on the above, it can be readily appreciated that the game of the present invention is unique in that it simulates the business aspects associated with the ownership of a sports team. It is also unique in the way that it can be varied by those playing the game to achieve a greater level of challenge and complexity. It should further be apparent that the present game is not limited to the game of baseball and could be applied to any number of different sports. Such variations of the present game could be enjoyed by a variety of participants as only a minimal knowledge of the sport to which the game relates is required. Rather, communication skills, deal-making prowess, luck and strategy are what is needed to prevail.

It should also be appreciated by one having skill in the art that the present game is also readily adaptable to electronic implementation, such as in the form of a computer or video game. The present game provides advantages over existing electronic network games in that it can be played by a group of players in one place and encourages a greater degree of personal interaction without necessitating an algorithm based on actual statistics.

The foregoing discussion discloses and describes merely an exemplary embodiment of the present invention. One skilled in the art will readily recognize from such discussion, and from the accompanying drawings and claims, that various changes, modifications and variations can be made therein without departing from the spirit and scope of the invention as defined in the following claims.

I claim:

1. A board game wherein each player represents an owner of a sports team comprising:

(a) a plurality of differently identified playing pieces each assigned to a different player;

(b) a game board having an endless path of contiguous spaces;

(c) means for generating a random number, said playing piece of each said owner being moved in turn from space to space on said endless path in accordance with a number randomly generated;

(d) specific indicia designations on each said space, said designations indicating a task, penalty or reward for a player of the game whose playing piece lands on that space;

(e) a plurality of stacks of cards associated with preselected spaces on said board, said designations on said preselected spaces instructing a player to draw from a specific stack of cards, said stacks of cards including a first stack of team member cards including indicia thereon indicating a sports team member and a salary and revenue value associated with that team member, and a second stack of championship cards including thereon indicia having a specific point value assigned thereto; and (f) means representing money, each player collecting team member cards and said designation on at least one of said spaces of said endless path instructing a player to pay an amount of money equal to the combined salaries indicated on all team member cards collected by said player.

2. The game of claim 1 further comprising a second path of contiguous spaces, each space in said second path having specific indicia designations thereon including designations indicative of entrance from and return to said endless path.

3. The game of claim 2 wherein said indicia designation on at least one said space on said endless path provides that a player may move his or her playing piece to said second path.

4. The game of claim 2 wherein said second path is an annular path disposed inside said endless path.

5. The game of claim 1 further comprising a third stack of cards, each said card in said third stack containing indicia of a task, penalty or reward for a player of the game drawing that card.

6. The game of claim 1 wherein said game relates to the sport of baseball and said endless path of contiguous spaces represents a base path, at least one space on said endless path having indicia thereon corresponding to each of home plate, first base, second base and third base.

7. The game of claim 1 wherein said designation on at least one space of said endless path instructs a player to collect an amount of money equal to the combined revenue values indicated on all team member cards collected by said player.

8. The game of claim 1 wherein at least one said designation instructs a player to draw from one of said plurality of stacks of cards.

9. The game of claim 1 wherein said designation on at least one space of said endless path instructs a player to move his or her associated playing piece to a different one of said spaces on said endless path.

10. The game of claim 1 wherein at least one of said spaces includes indicia thereon instructing a player to choose between at least two options.

11. The game of claim 1 wherein said championship cards include indicia thereon of playoff and league championship wins and losses and wherein said point values corresponding to said playoff wins are a fraction of those corresponding to said championship wins.

12. A method of playing a board game based on the ownership of a sports team, the board game including a playing board having an endless path disposed thereon, said endless path being divided into a plurality of contiguous spaces; a plurality of differently identified playing pieces, each assigned to a different player; a random number generating means for determining advancement of said playing pieces around the path from space to space; and a plurality of stacks of cards associated with preselected spaces on said board, said preselected spaces referring a player to a specific one of said stacks of cards, said stacks of cards including a first stack of team member cards each having indicia thereon indicative of a sports team member, said cards in said first stack being of a plurality of different types of sports team members, and a second stack of championship cards having indicia thereon corresponding to a specific point value, said method comprising the steps of:

(a) advancing a playing piece a predetermined number of spaces on said endless path as determined by said random number generating means;

(b) collecting cards from said first stack, wherein when a player's playing piece lands on a space associated therewith, said player randomly selecting a card from said first stack;

(c) collecting cards from said second stack wherein after a player having collected a predefined number of different types of cards from said first stack and said player's playing piece lands on a space associated therewith, said player selecting a card from said second stack; and (d) terminating play when at least one player accumulates a predefined number of cards from said first stack, at least one card being of each said type, and cards from said second stack having point values which equal or exceed a predefined number.

13. The method of claim 12 further comprising the step of trading team member cards with other players from time to time.

14. The method of claim 12 wherein said board game includes means representing money and further comprising the step of selling team member cards to other players.

15. The method of claim 14 wherein said players may bid on one of said team member cards.

16. The method of claim 12 wherein each said team member card includes an indicia designation thereon indicating a position played by said team member and wherein said different types of team member cards must include one card having a designation corresponding to each position of a complete team.

17. The method of claim 16 wherein said sport is baseball and each player must collect team member cards indicating player positions of catcher, first base, second base, third base, shortstop, center field, right field and left field.

18. The method of claim 12 further including the step of discarding said team member cards from time to time.

* * * * *